US006929290B2

(12) United States Patent
Don

(10) Patent No.: US 6,929,290 B2
(45) Date of Patent: Aug. 16, 2005

(54) ADJUSTABLE BUTTON MECHANISM FOR A LOCK

(75) Inventor: Lan-Kum Don, Chiayi (TW)

(73) Assignee: Tung Lung Metal Industry Co., Ltd., Chiayi (TW)

( * ) Notice: Subject to any disclaimer, the term of this patent is extended or adjusted under 35 U.S.C. 154(b) by 50 days.

(21) Appl. No.: 10/452,427

(22) Filed: Jun. 3, 2003

(65) Prior Publication Data

US 2003/0222464 A1 Dec. 4, 2003

(30) Foreign Application Priority Data

Jun. 4, 2002 (TW) ..... 91208291 U

(51) Int. Cl.[7] ..... E05C 1/12

(52) U.S. Cl. ..... 292/169; 292/169.14; 292/347; 292/348; 292/DIG. 60; 70/224

(58) Field of Search ..... 292/169, 169.14, 292/347, 348, 336.5, DIG. 37, 60, 336.3, DIG. 53, 6, 169.18; 70/224, 461, 472, 481

(56) References Cited

U.S. PATENT DOCUMENTS

| | | | | | |
|---|---|---|---|---|---|
| 1,638,688 | A | * | 8/1927 | Fipps | 70/195 |
| 2,207,143 | A | * | 7/1940 | Brauning | 292/337 |
| 2,497,328 | A | * | 2/1950 | Smith et al. | 292/169.18 |
| 2,650,123 | A | * | 8/1953 | Hopgood | 292/169.18 |
| 2,743,123 | A | * | 4/1956 | Alexander | 292/1 |
| 3,025,096 | A | * | 3/1962 | Williams | 292/359 |
| 3,800,573 | A | * | 4/1974 | Babb et al. | 70/217 |
| 3,877,263 | A | * | 4/1975 | Strickler et al. | 70/149 |
| 4,192,537 | A | * | 3/1980 | Laine | 292/264 |
| 4,920,773 | A | * | 5/1990 | Surko, Jr. | 70/224 |
| 5,141,269 | A | * | 8/1992 | Haq et al. | 292/169 |
| 5,232,255 | A | * | 8/1993 | Palmer et al. | 292/336.3 |
| 5,284,372 | A | * | 2/1994 | Lin | 292/336.3 |
| 5,934,117 | A | * | 8/1999 | Shen | 70/224 |
| 5,983,687 | A | * | 11/1999 | Shen | 70/467 |

FOREIGN PATENT DOCUMENTS

| | | |
|---|---|---|
| CN | 090200573 | 1/1990 |

* cited by examiner

*Primary Examiner*—Daniel P. Stodola
*Assistant Examiner*—Carlos Lugo
(74) *Attorney, Agent, or Firm*—Senniger Powers

(57) ABSTRACT

An adjustable button mechanism for a lock includes: a driving tube of a hollow tubular shape, having a first end and a second end, the first end connecting to a driving mechanism of the lock, the second end forming a positioning slot; a connecting member having a first end forming an axial hole and a second end; a protruding member formed at the first end of the connecting member and radially extending into the positioning slot of the driving tube; a button lever placed within the driving tube, and having a first end and a second end, the first end connecting to the driving mechanism, the second end being inserted into the axial hole of the connecting member; and a button placed on the second end of the connecting member, and either the connecting member or the button having an elastically supported lateral member, with the other containing a plurality of holes for selectively receiving the lateral member.

5 Claims, 8 Drawing Sheets

ADJUSTABLE BUTTON MECHANISM FOR A LOCK

BACKGROUND OF THE INVENTION (A) Field of the Invention

The present invention relates to an adjustable button mechanism for a lock. Particularly, the present invention relates to a button and button lever combination for an adjustable lock and modifies the lock disclosed in ROC (Taiwan) New Utility Model Pat. Appln. No. 090200573 which was filed on 11, Jan. 2001 by the Inventor of the present invention and published on 11, Feb. 2002 under Pat. Pub. No. 476368.

(B) Description of the Relevant Art

FIGS. 1 to 3 illustrate a lock disclosed in ROC (Taiwan) New Utility Model Pat. Appln. No. 090200573. As illustrated, the lock comprises a latch 1, a driving mechanism 2 for driving the latch 1, and a round covering set 3 for clamping the driving mechanism 2 and fixing it on the door panel, wherein the driving mechanism 2 comprises:

a button lever 23 having one end connecting to the driving mechanism 2, and the other end formed with a plurality of slots 231; and a button 24 having an adjusting plate 25 which is selective to engage with one of the slots 231 of the button lever 23.

Based on the above construction, the lock can be adjusted to be installed on a thick door panel (See FIG. 2), as well as on a thin door panel (See FIG. 3).

However, in view of the fact that there are still many different kinds of operating modes needed for the adjustment of the reciprocal combination position of the button and the button lever for locks, the present invention is, hence, created in order to satisfy the needs of different users.

SUMMARY OF THE INVENTION

Therefore, the primary objective of the present invention is to provide an adjustable button mechanism for a lock.

A further objective of the present invention is to provide a mechanism which makes the adjustment of the reciprocal combination position of the button and the button lever easier.

Based on the above objectives, the adjustable button mechanism for a lock in accordance with the present invention includes:

a driving tube of a hollow tubular shape, having a first end and a second end, the first end connecting to a driving mechanism of the lock, the second end forming a positioning slot;

a connecting member having a first end forming an axial hole and a second end;

a protruding member formed at the first end of the connecting member and radially extending into the positioning slot of the driving tube;

a button lever placed within the driving tube, and having a first end and a second end, the first end connecting to the driving mechanism, the second end being inserted into the axial hole of the connecting member; and a button placed on the second end of the connecting member, and either the connecting member or the button having an elastically supported lateral member, with the other containing a plurality of holes for selectively receiving the lateral member.

The structure and objectives of the present invention can be more readily understood by persons skilled in the art from the following description of the preferred embodiments taken in conjunction with the accompanying drawings.

DETAILED DESCRIPTION OF THE INVENTION

Figure 1:
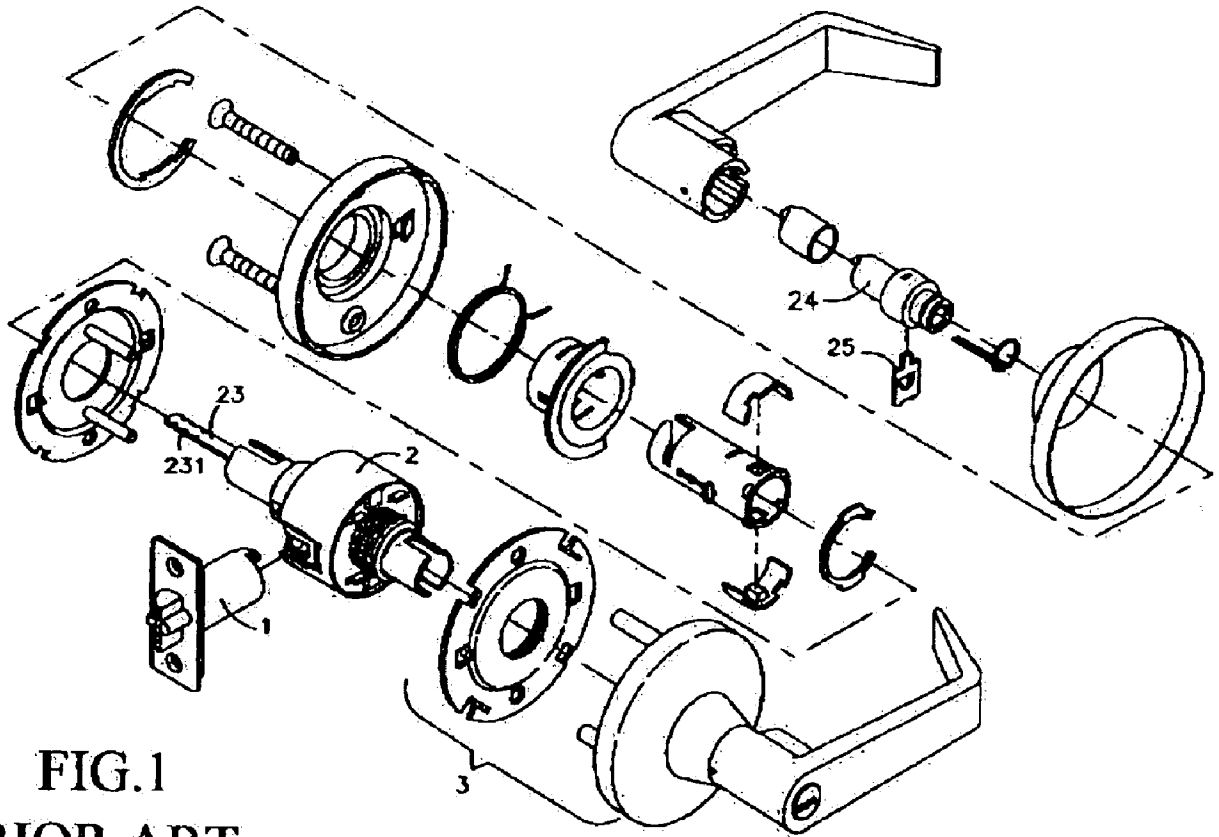
FIG.1 PRIOR ART
FIG. 1 is an exploded view of a lock disclosed in ROC New Model Patent Application No. 090200573.
Figure 2:
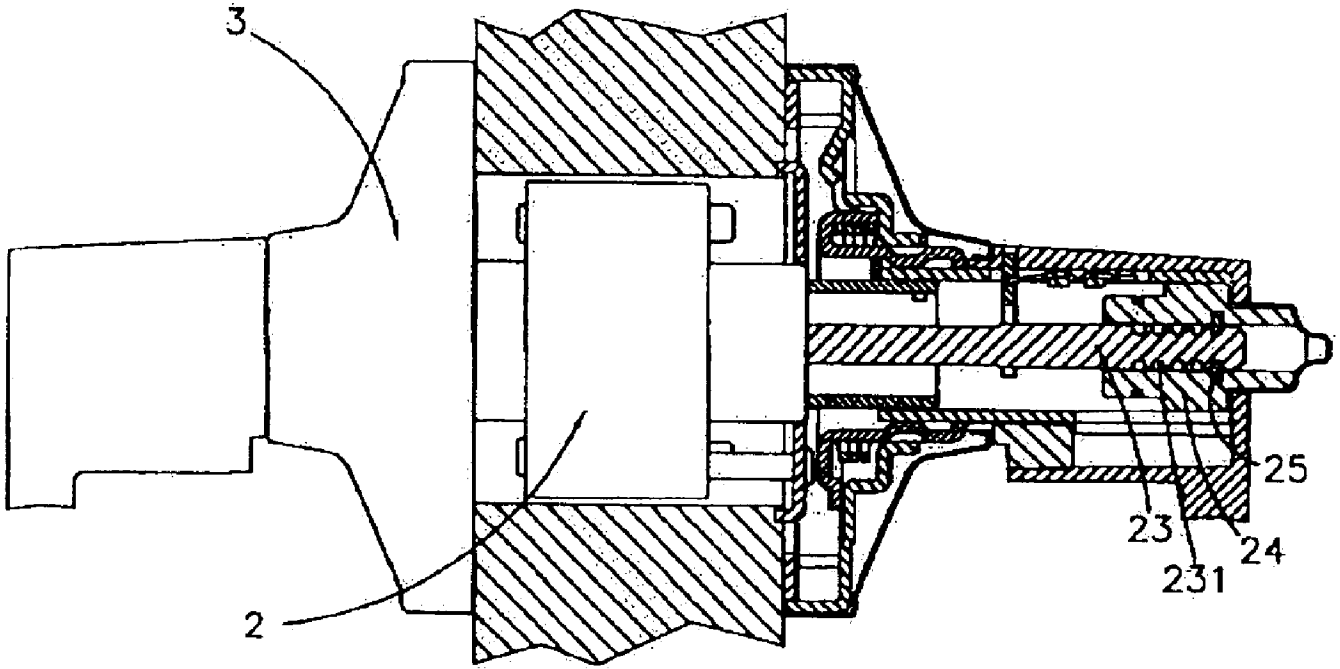
FIG.2 PRIOR ART
FIG. 2 is a partial sectional view of the lock illustrated in FIG. 1 which is installed on a thick door panel.
Figure 3:
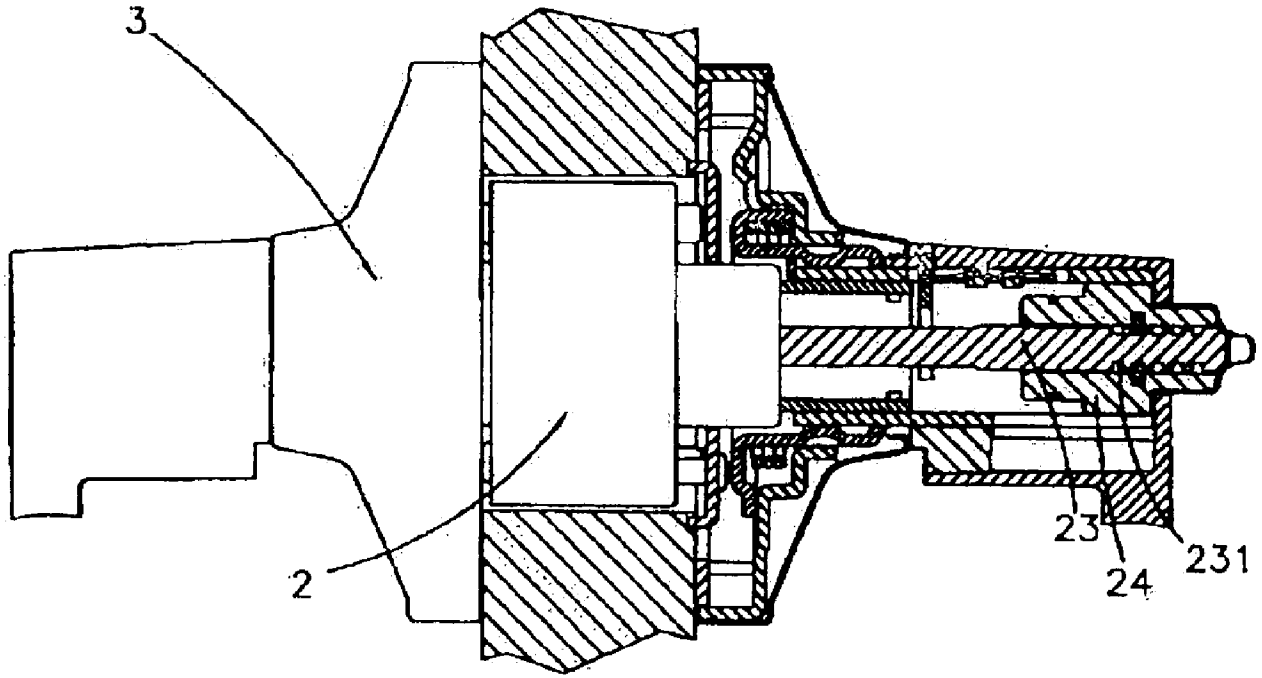
FIG.3 PRIOR ART
FIG. 3 is a partial sectional view of the lock illustrated in FIG. 1 which is installed on a thin door panel.
Figure 4:
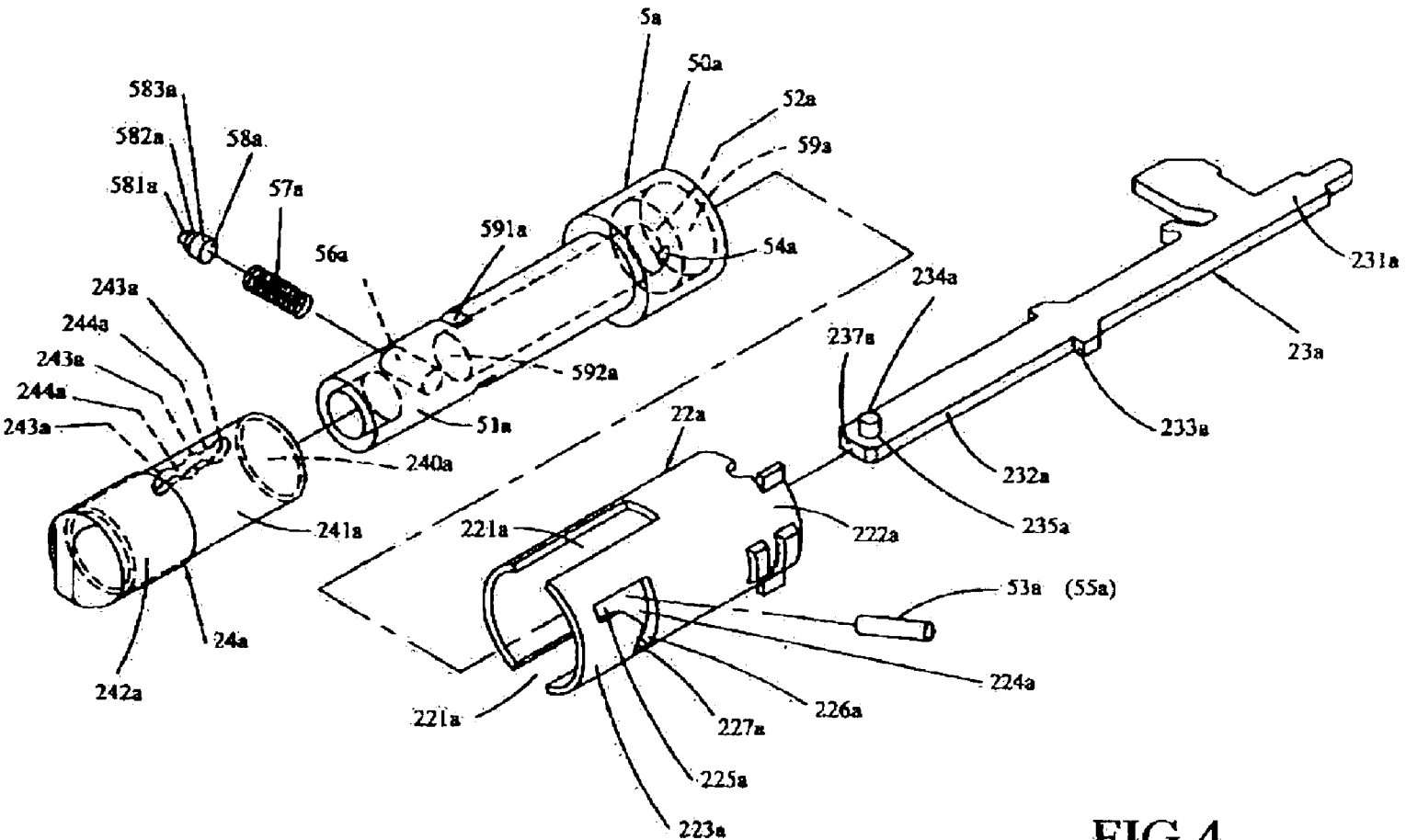
FIG. 4 is an exploded view of an adjustable button mechanism for a lock in accordance with the present invention.
Figure 5:
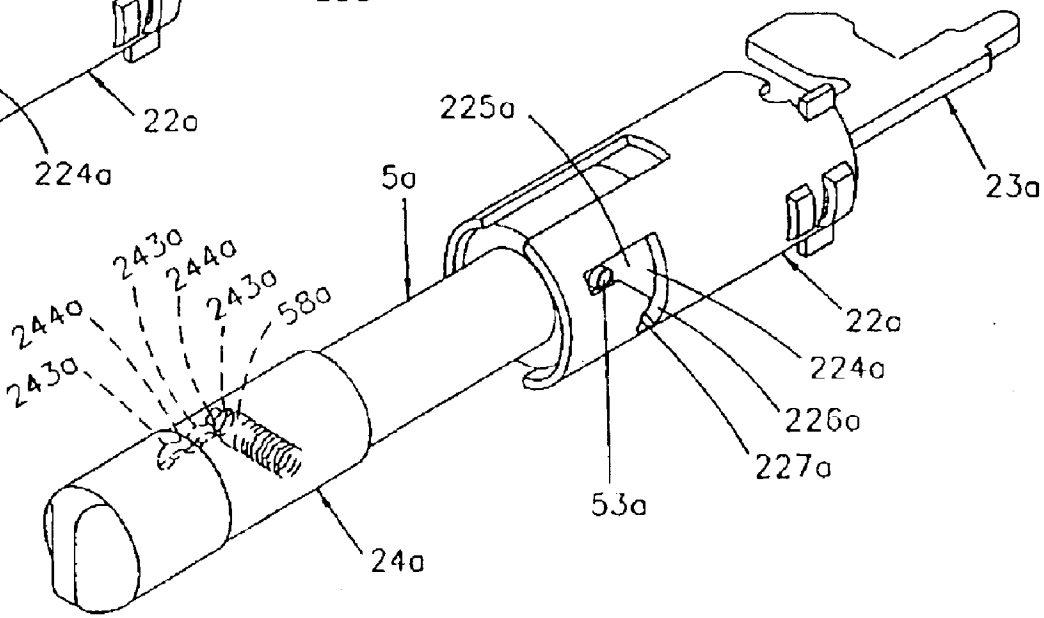
FIG. 5 is a perspective view of an adjustable button mechanism for a lock in accordance with the present invention, wherein the length of the mechanism is adjusted to be long.
Figure 8:
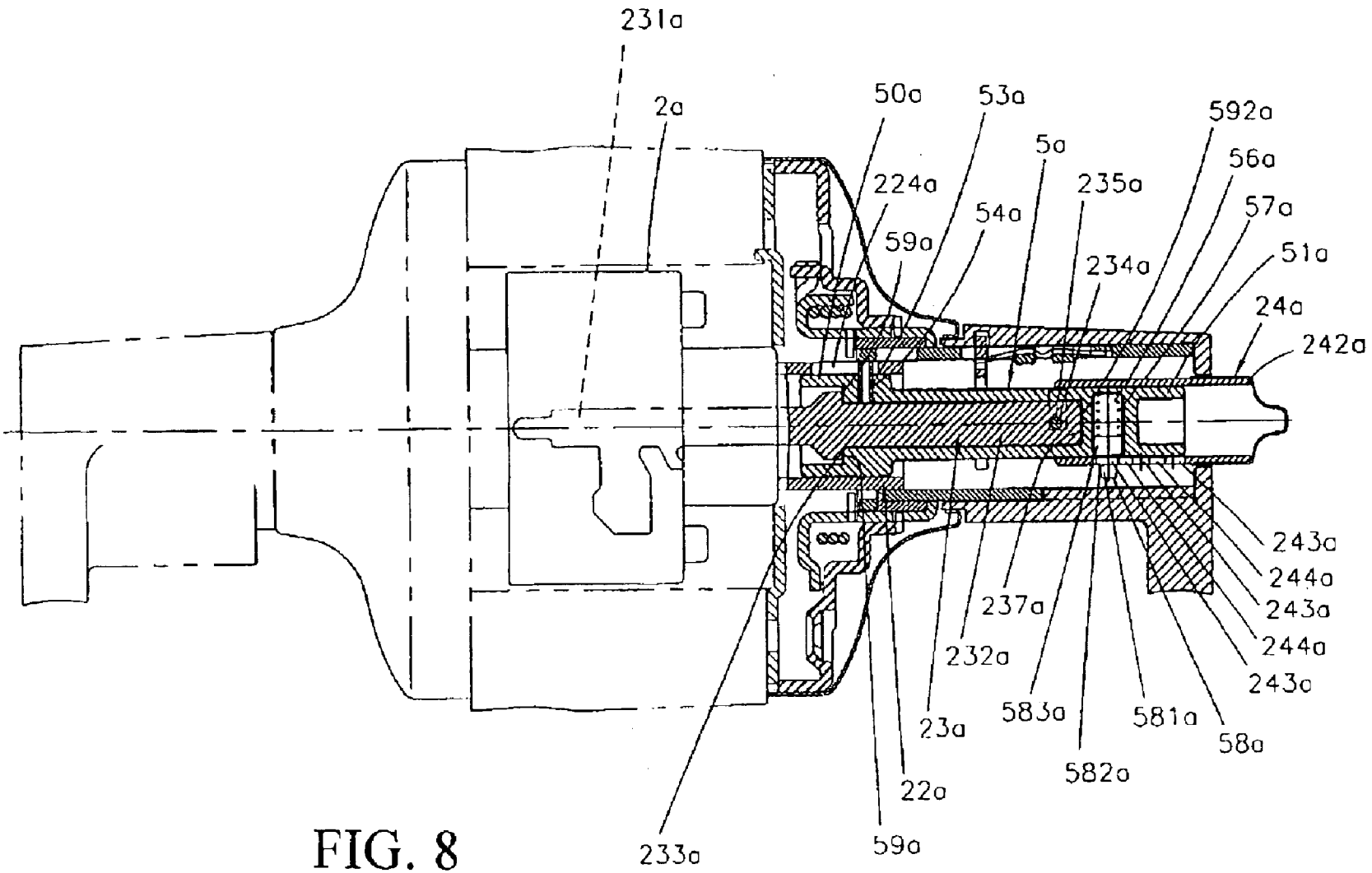
FIG. 8 is a schematic view of an adjustable button mechanism for a lock in accordance with the present invention, wherein the mechanism is placed within the lock and the lock is installed onto a thick door panel, wherein the length of the mechanism is adjusted to be long.

The adjustable button mechanism for a lock in accordance with the preferred embodiment of the present invention can be described, with the accompanying drawings, in further detail as follows:

As illustrated in FIG. 4, FIG. 5, and FIG. 8, the adjustable button mechanism for a lock in accordance with a preferred embodiment of the present invention comprises a driving tube 22*a*, a connecting member 5*a*, a button lever 23*a*, and a button 24*a*.

The driving tube 22*a* is of a hollow tubular shape which comprises a first end 222*a* and a second end 223*a*. The first end 222*a* connects to a driving mechanism 2*a* of a lock and the second end 223*a* defines a pair of axial slots 221*a*, 221*a* diametrically opposite to each other. An L-shaped positioning slot 224*a*, consisting of an axial slot 225*a* and a lateral slot 226*a* orthogonally interconnected at an end thereof, is formed on the wall of the driving tube 22*a*. A shoulder 227*a* is further formed from an edge of the lateral slot 226*a*.

The connecting member 5*a* has a first end 50*a* and a second end 51*a*. The first end 50*a* forms an axial hole 52*a*, as well as an engaging portion 59*a* therein. The axial hole 52*a* defines a bottom face 592*a*. A radially outward protruding member 53*a* is further formed on the wall near the first end 50*a* by integrally forming with the first end 50*a*, or by presetting a hole 54*a* on the first end 50*a* and inserting a pin

Figure 7:
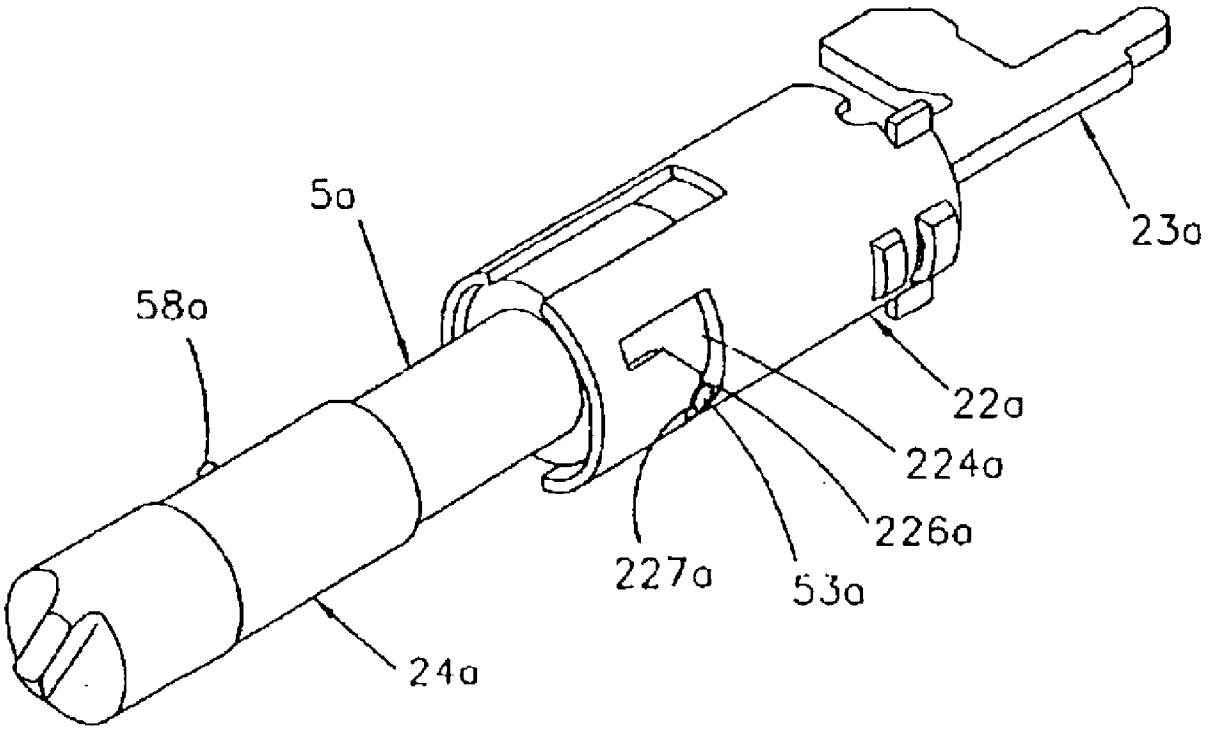
FIG. 7 is a schematic view of an adjustable button mechanism for a lock in accordance with the present invention, illustrating the positioning of the button by pressing the button and rotating the button with an angular displacement.

53*a* thereinto. The connecting member 5*a* is received within the driving tube 22*a* such that in an unlocked state, the protruding member 53*a* is located within the axial slot 225*a* of the positioning slot 224*a* of the driving tube 22*a* (as shown in FIG. 5); and in a locked state, the protruding member 53*a* is pressed against the shoulder 227*a* of the lateral slot 226*a* of the driving tube 22*a* (as shown in FIG. 7).

A lateral slot 591*a* is further formed between the first end 50*a* and the second end 51*a* of the connecting member 5*a*, and communicates to the axial hole 52*a* of the connecting member 5*a*.

Near the second end 51*a* of the connecting member 5*a*, a lateral hole 56*a* is formed for receiving an elastic member or a spring 57*a*, and a lateral member 58*a*. The lateral member 58*a* can be a pin with unequal cross sections (stepped) or a plate. In the current embodiment, the lateral member is a pin 58*a* supported by the spring 57*a*. The pin 58*a* is stepped and defines a first section 581*a*, a second section 582*a* and a third section 583*a*, wherein the diameter of the cross section of the second section 582*a* is larger than that of the first section 581*a* and is smaller than that of the third section 583*a*.

The button lever 23*a* is also received within the driving tube 22*a*, and contains a first end 231*a* and a second end 232*a*. The first end 231*a* connects to the driving mechanism 2*a* and is supported by a spring (not shown). A protruding member 234*a* is formed at the second end 232*a* by integrally forming therewith, or by presetting a hole 235*a* on the second end 232*a* and inserting a pin 234*a* thereinto. By engaging the protruding member 234*a* with the lateral slot 591*a* of the connecting member 5*a*, the second end 232*a* of the button lever 23*a* is placed within the axial hole 52*a* of the connecting member 5*a* and the connecting member 5*a* can rotate a certain angular displacement with respect to the button lever 23*a*.

The button lever 23*a* further comprises an engaging portion 233*a* for engaging with the engaging portion 59*a* of the connecting member 5*a*. In the current embodiment, the engaging portion 233*a* is formed between the first end 231*a* and the second end 232*a*. In addition, the second end 232*a* of the button lever 23*a* can have an end face 237*a* which abuts on the bottom face 592*a* of the axial hole 52*a*.

As shown in FIG. 4, the button 24*a* has a first end 241*a* and a second end 242*a*. The second end 242*a* has a gripping surface. Further, the first end 241*a* is formed with an axial hole 240*a* for fitting to the second end 51*a* of the connecting member 5*a*. In addition, a serial of holes 243*a* are formed laterally on the wall of the button 24*a* with the adjacent holes 243*a* communicating to each other by means of a groove 244*a*.

The diameter of the cross section of the first section 581*a* of the lateral member 58*a* of the connecting member 5*a* is less than the width of the groove 244*a*. Further, the diameter of the cross section of the second section 582*a* is less than the diameter of the hole 243*a* and larger than the width of the groove 244*a*. In addition, the diameter of the cross section of the third section 583*a* is larger than the diameter of the hole 243*a*. Accordingly, since the lateral member 58*a* is elastically supported by the spring 57*a*, by fitting the button 24*a* to the second end 51*a* of the connecting member 5*a*, the lateral member 58*a* of the connecting member 5*a* can selectively and adjustably engage with one of the holes 243*a*.

Figure 6:
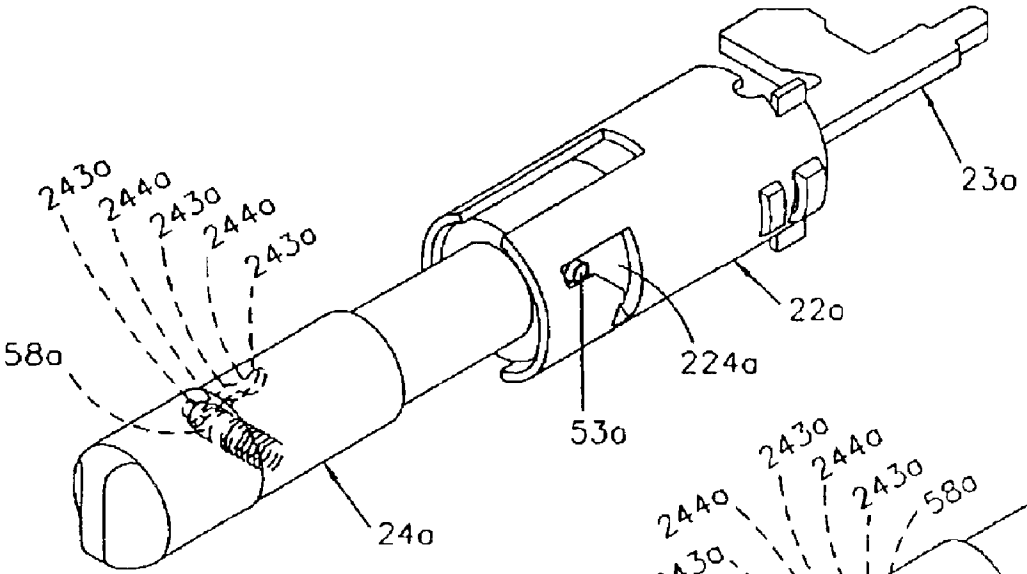
FIG. 6 is a perspective view of an adjustable button mechanism for a lock in accordance with the present invention, wherein the length of the mechanism is adjusted to be short.

Based on the above disclosure, the adjustable button mechanism for a lock in accordance with the present invention is constructed. As shown in FIG. 5, the length of the adjustable button mechanism is adjusted to be long; and as shown in FIG. 6, the length of the adjustable button mechanism is adjusted to be short.

To set the button in a locked state, first, a user presses the button 24*a* such that the button 24*a*, the connecting member 5*a*, and the button lever 23*a* move axially with respect to the driving tube 22*a*. At this moment, the protruding member 53*a* of the connecting member 5*a* reaches the end of the axial slot 225*a*, as well as the end of the lateral slot 226*a*. By further rotating the button 24*a*, the button 24*a* and the connecting member 5*a* create an angular displacement with respect to the driving tube 22*a*. At this moment, the protruding member 53*a* of the connecting member 5*a* will be positioned by the shoulder 227*a* of the lateral slot 226*a* of the driving tube 22*a*, as shown in FIG. 7.

The adjustable button mechanism for a lock of the present invention can be installed or combined to locksets. Since the parts and effects of locks, such as the driving mechanism, the round covering set, and the handle have been described in detail previously in ROC (Taiwan) New Utility Model Pat. Appln. No. 090200573, such reference is not intended to be set forth herein to avoid redundancy.

FIG. 8 is a schematic view of an adjustable button mechanism for a lock in accordance with the present invention, wherein the mechanism is placed within the lock and the lock is installed onto a thick door panel, wherein the length of the mechanism is adjusted to be long.

Figure 9:
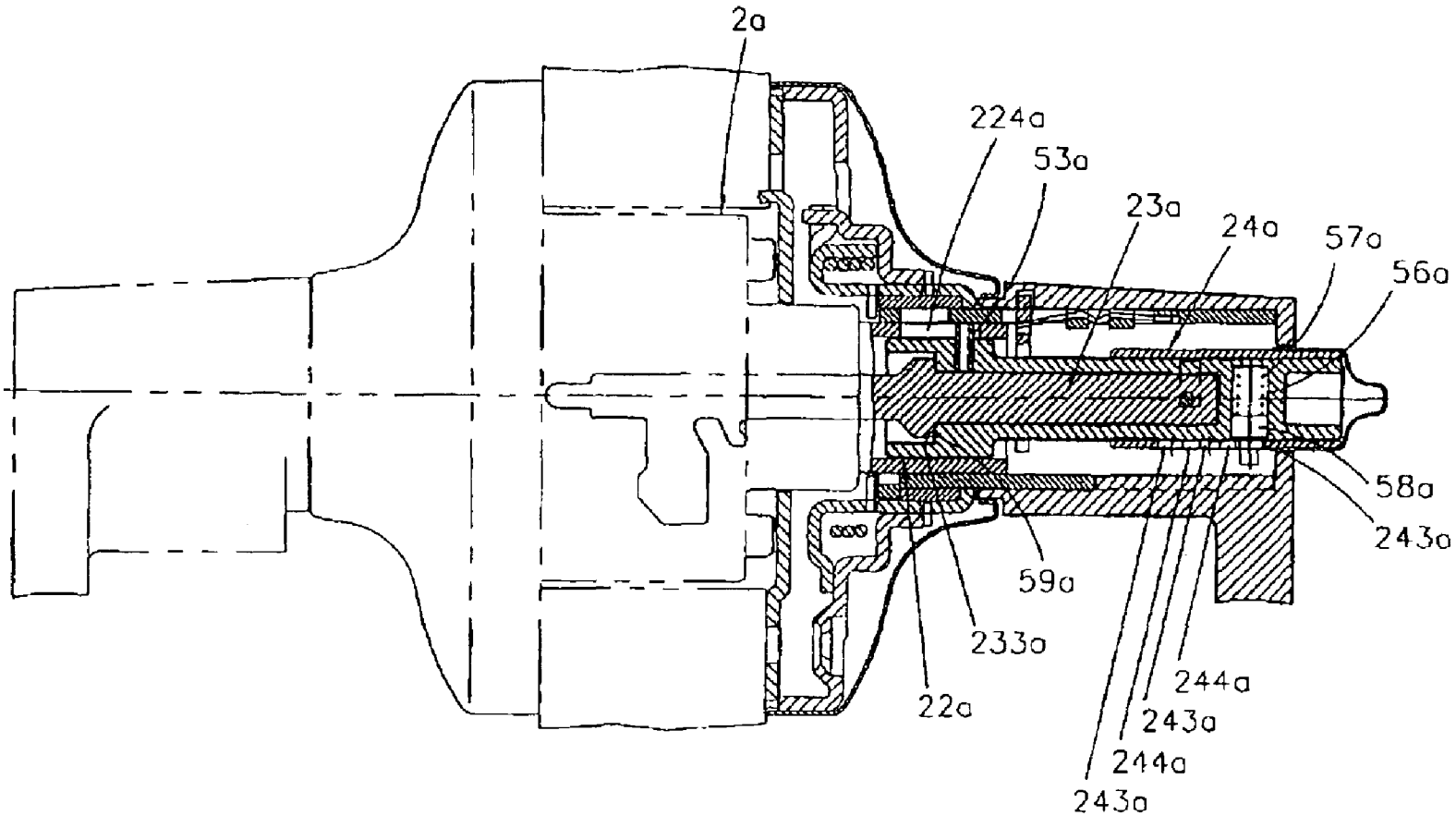
FIG. 9 is a schematic view of an adjustable button mechanism for a lock in accordance with the present invention, wherein the mechanism is placed within the lock and the lock is installed onto a thin door panel, wherein the length of the mechanism is adjusted to be short.

FIG. 9 is a schematic view of an adjustable button mechanism for a lock in accordance with the present invention, wherein the mechanism is placed within the lock and the lock is installed onto a thin door panel, wherein the length of the mechanism is adjusted to be short.

Additionally, the adjustable button mechanism of the present invention can have modifications with respect to the fitting between the connecting member 5*a* and the button 24*a*. For instance, an axial hole can be formed at the second end 51*a* of the connecting member 5*a* to receive the first end 241*a* of the button 24*a*, while a plurality of holes, as well as the intercommunicated grooves are formed at the second end 51*a* of the connecting member 5*a*. Further, a lateral hole is formed at the first end 241*a* of the button 24*a* to receive a spring and a lateral member such that the lateral member can selectively engage with one of the plurality of holes. Such an equivalent change in structure, even with the other relevant elements unchanged, is still possible to achieve the performances specifically proclaimed hereinbefore by the embodiment of the present invention.

The above descriptions have clearly illustrated the important features, operational methods and applications of the present invention. Although the invention has been described with reference to the preferred embodiments, it will be obvious to persons skilled in the art that various changes and modifications may be made without departing from the scope of the invention as recited in the claims.

SEQUENCE LISTING

1 Latch
2 Driving mechanism
23 Button lever
231 Slot
24 Button
25 Adjusting plate
3 Round covering set
2*a* Driving mechanism
22*a* Driving tube
221*a* Axial slot

222*a* First end of the driving tube 22*a*
223*a* Second end of the driving tube 22*a*
224*a* Positioning slot
225*a* Axial slot
226*a* Lateral slot
227*a* Shoulder
23*a* Button lever
231*a* First end of the button lever 23*a*
232*a* Second end of the button lever 23*a*
233*a* Engaging portion
234*a* Protruding member or pin
235*a* Hole
237*a* End face
24*a* Button
240*a* Axial hole
241*a* First end of the button 24*a*
242*a* Second end of the button 24*a*
243*a* Hole
244*a* Groove
5*a* Connecting member
50*a* First end of the connecting member 5*a*
51*a* Second end of the connecting member 5*a*
52*a* Axial hole
53*a* Protruding member or pin
54*a* Hole
56*a* Lateral hole
57*a* Elastic member or spring
58*a* Lateral member
581*a* First section
582*a* Second section
583*a* Third section
59*a* Engaging portion
591*a* Lateral slot
592*a* Bottom face

What is claimed is:

1. An adjustable button mechanism for a lock, comprising:

a driving tube of a hollow tubular shape, having a first end and a second end, said first end connecting to a driving mechanism of said lock, and said second end forming a positioning slot;

a connecting member having a first end and a second end, said first end forming an axial hole, and said second end forming a lateral hole;

a protruding member formed at said first end of said connecting member and radially extending into said positioning slot of said driving tube;

a button lever placed within said driving tube, and having a first end and a second end, said first end connecting to said driving mechanism of said lock, and said second end being inserted into said axial hole of said connecting member;

an elastically supported lateral member supported by an elastic member and received with in said lateral hole of said connecting member;

a button placed on said second end of said connecting member, said button laterally formed with a plurality of holes for selectively receiving said lateral member; and a groove is formed for communication between two adjacent holes of said button.

2. The adjustable button mechanism as claimed in claim 1, wherein said lateral member is a pin.

3. The adjustable button mechanism as claimed in claim 1, wherein said button lever and said connecting member respectively have an engaging portion for reciprocal contact thereof.

4. An adjustable button mechanism for a lock, comprising:

a driving tube of a hollow tubular shape, having a first end and a second end, said first end connecting to a driving mechanism of said lock, and said second end forming a positioning slot;

a connecting member having a first end and a second end, said first end forming an axial hole, and said second end forming a lateral hole;

a protruding member formed at said first end of said connecting member and radially extending into said positioning slot of said driving tube;

a button lever placed within said driving tube, and having a first end and a second end, said first end connecting to said driving mechanism of said lock, and said second end being inserted into said axial hole of said connecting member;

said button lever further has a protruding member and said connecting member further has a lateral slot for engaging with said protruding member of said button lever;

an elastically supported lateral member supported by said an elastic member and received with in said lateral hole of said connecting member; and a button placed on said second end of said connecting member, said button laterally formed with a plurality of holes for selectively receiving said lateral member.

5. The adjustable button mechanism as claimed in claim 4, wherein said positioning slot is formed by orthogonally interconnecting an axial slot to a horizontal slot.

* * * * *

UNITED STATES PATENT AND TRADEMARK OFFICE

CERTIFICATE OF CORRECTION

PATENT NO. : 6,929,290 B2
DATED : August 16, 2005
INVENTOR(S) : Lan-Kun Don

It is certified that error appears in the above-identified patent and that said Letters Patent is hereby corrected as shown below:

Title page,
Item [75], Inventor, should read -- Lan-Kun Don, Chiayi (TW) --.

Signed and Sealed this

Twenty-fifth Day of October, 2005

JON W. DUDAS
*Director of the United States Patent and Trademark Office*

UNITED STATES PATENT AND TRADEMARK OFFICE

CERTIFICATE OF CORRECTION

PATENT NO. : 6,929,290 B2
DATED : August 15, 2005
INVENTOR(S) : Lan-Kun Don

It is certified that error appears in the above-identified patent and that said Letters Patent is hereby corrected as shown below:

Title page,
Item [73], Assignee, should read -- Tong Lung Metal Industry Co., Ltd. --.

Signed and Sealed this

Twenty-eighth Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,929,290 B2
DATED : August 16, 2005
INVENTOR(S) : Lan-Kun Don

It is certified that error appears in the above-identified patent and that said Letters Patent is hereby corrected as shown below:

Title page,
Item [73], Assignee, should read -- Tong Lung Metal Industry Co., Ltd. --.

This certificate supersedes Certificate of Correction issued March 28, 2006.

Signed and Sealed this

Second Day of May, 2006

JON W. DUDAS
*Director of the United States Patent and Trademark Office*